United States Patent [19]

Valier

[11] Patent Number: 4,660,626

[45] Date of Patent: Apr. 28, 1987

[54] HEAT EXCHANGER IN PARTICULAR A RADIATOR FOR A MOTOR VEHICLE COOLING CIRCUIT

[75] Inventor: Marco Valier, Turin, Italy

[73] Assignee: Valeo, Paris, France

[21] Appl. No.: 768,450

[22] Filed: Aug. 22, 1985

[30] Foreign Application Priority Data

Aug. 22, 1984 [FR] France ..... 84 13081

[51] Int. Cl.[4] ..... F28F 7/00

[52] U.S. Cl. ..... 165/76; 165/162; 165/173

[58] Field of Search ..... 165/69, 162, 76, 172, 165/173, 149

[56] References Cited

U.S. PATENT DOCUMENTS

| | | | |
|---|---|---|---|
| 1,407,867 | 5/1922 | Potter | 165/172 X |
| 1,834,001 | 12/1931 | Modine | 165/69 X |
| 1,899,629 | 2/1933 | Morse | 165/149 X |
| 2,184,657 | 12/1939 | Young | 165/149 X |
| 2,298,996 | 10/1942 | Woods | 165/149 |
| 3,191,670 | 6/1965 | Jones . | |
| 3,472,316 | 10/1969 | Couch, Jr. | 165/149 X |
| 4,373,578 | 2/1983 | Saperstein et al. . | |
| 4,456,059 | 6/1984 | Cadars | 165/69 X |
| 4,570,704 | 2/1986 | Braun et al. | 165/172 X |

FOREIGN PATENT DOCUMENTS

| | | | |
|---|---|---|---|
| 2166469 | 5/1974 | Fed. Rep. of Germany | 165/172 |
| 3045087 | 7/1982 | Fed. Rep. of Germany . | |
| 2506000 | 11/1982 | France . | |
| 2549945 | 7/1983 | France . | |

*Primary Examiner*—William R. Cline
*Assistant Examiner*—Richard R. Cole
*Attorney, Agent, or Firm*—Dennison, Meserole, Pollack & Scheiner

[57] ABSTRACT

A heat exchanger, in particular a radiator for the cooling circuit of a motor vehicle engine. The invention relates to a heat exchanger having a bundle (10) of finned tubes which is built up from at least two assemblies (20, 22) of finned tubes which are independent and juxtaposed, each assembly of tubes including a rigid plate (36) interposed between two fins, the rigid plates (26) being urged against one another by means of cross-members (39) and draw bars (40).

15 Claims, 3 Drawing Figures

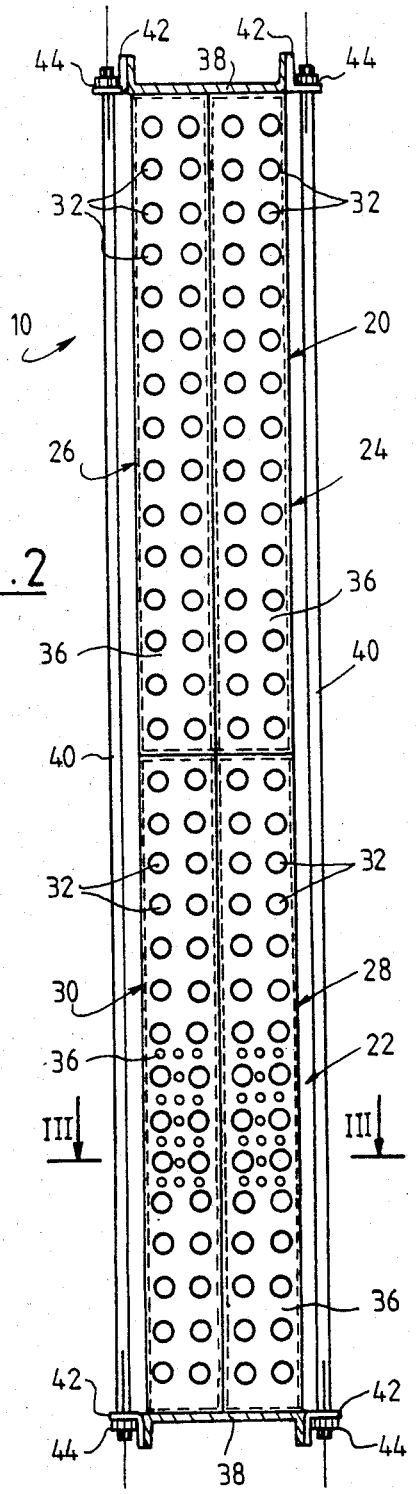
FIG. 2
FIG. 3
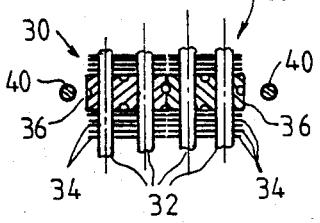

HEAT EXCHANGER IN PARTICULAR A RADIATOR FOR A MOTOR VEHICLE COOLING CIRCUIT

The present invention relates to a heat exchanger, in particular a radiator for a motor vehicle cooling circuit, which radiator comprises a bundle of finned tubes and at least one water box mounted at one end of the bundle, which bundle comprises at least two independent and juxtaposed sets of finned tubes.

BACKGROUND OF THE INVENTION

It is known that the radiator in the cooling circuit of the engine in a truck or the like is larger than the radiator for a passenger car, and consequently proposals have already been made to make up the bundles of tubes in such a radiator from at least two sets of finned tubes which are independent from one another and which are juxtaposed and mounted in parallel between the water boxes of the heat exchanger.

Each of these sets of finned tubes, corresponding to a fraction of the bundle of tubes in the radiator is simpler and easier to manufacture and to manipulate than would be a single bundle corresponding to the juxtaposition of these sets of tubes. In particular, the fins on the tubes in these sets have a surface area which is two (or more) times less than the surface area of the fins which would be fitted to the tubes in a single-assembly bundle. Since these fins are generally made of aluminum and are very thin, e.g. about 0.1 mm, reducing their size greatly facilitates manufacture and assembly of a radiator bundle, and also improves its mechanical behaviour.

However, a heat exchanger whose bundle is built up from two or more independent assemblies of finned tubes which are juxtaposed as close as possible is nevertheless subjected to considerable vibration in use which can cause the fins of said assemblies to strike one another along their facing edges, thereby crushing or otherwise deforming said edges.

Preferred embodiments of the invention avoid these drawbacks in a simple manner which costs little and is particularly effective.

SUMMARY OF THE INVENTION

To this end, the present invention provides a heat exchanger, in particular a radiator for the cooling circuit of a motor vehicle, comprising a bundle of finned tubes and at least one water box mounted at one end of the bundle, said bundle being built up from at least two independent and juxtaposed sets of finned tubes, with the improvement whereby first means are provided to urge said sets of finned tubes towards one another in a plane perpendicular to the tubes in said sets, and second means are provided in each set of tubes to tear against one another in a plane perpendicular to the tubes under the action of said first means.

The first means may comprise two parallel cross-members extending along two small faces of the bundle parallel to the tubes, which cross-members are interconnected in the middle by two draw bars, and are also interconnected at their ends, e.g. by the perforated plate and water box assemblies of the heat exchanger.

The second means of each set of tubes advantageously comprise a rigid plate having substantially the same shape as a fin and of slightly larger size which is interposed between two fins in the same set of tubes and through which the tubes of said set pass.

The assembly of each set of finned tubes is facilitated by the fact that the plate provided in said set is substantially the same shape as the fins and is only slightly larger in size. As a result, conventional means for assembling bundles of tubes can be used without modification.

When a heat exchanger in accordance with the invention is assembled, the above-mentioned plates in the said sets of tubes are juxtaposed in a common plane perpendicular to the tubes and they are clamped against one another and between the cross-members by means of the above-mentioned draw bars.

Since the plates are slightly larger than the fins where they come into contact with one another, the edges of the fins are held a short distance apart from one another.

This combination of means enables sets of finned tubes constituting the heat exchanger bundle to be held against the vibrations to which the heat exchanger is subjected in use without the edges of the fins in the juxtaposed sets of tubes teing deformed or crushed against one another.

A rigid and relatively undeformable structure is thus obtained due to the prestress exerted on the juxtaposed plates by the above-mentioned cross-members and draw bars.

Advantageously, the above-mentioned plates are made in a vibration-damping material, e.g. a plastic material and they are several times thicker than the fins, e.g. about 10 mm thick whereas the fins are made of aluminum and are about 0.1 mm thick.

In order to reduce weight and increase elasticity, the plates may include lightening cavities or grooves.

BRIEF DESCRIPTION OF THE DRAWINGS

An embodiment of the invention is described by way of example with reference to the accompanying drawings, in which:

FIG. 2 is a section view on a line II—II of FIG. 1, and to a larger scale; and

FIG. 3 is a section view on a line III—III of FIG. 2.

MORE DETAILED DESCRIPTION

Figure 1:
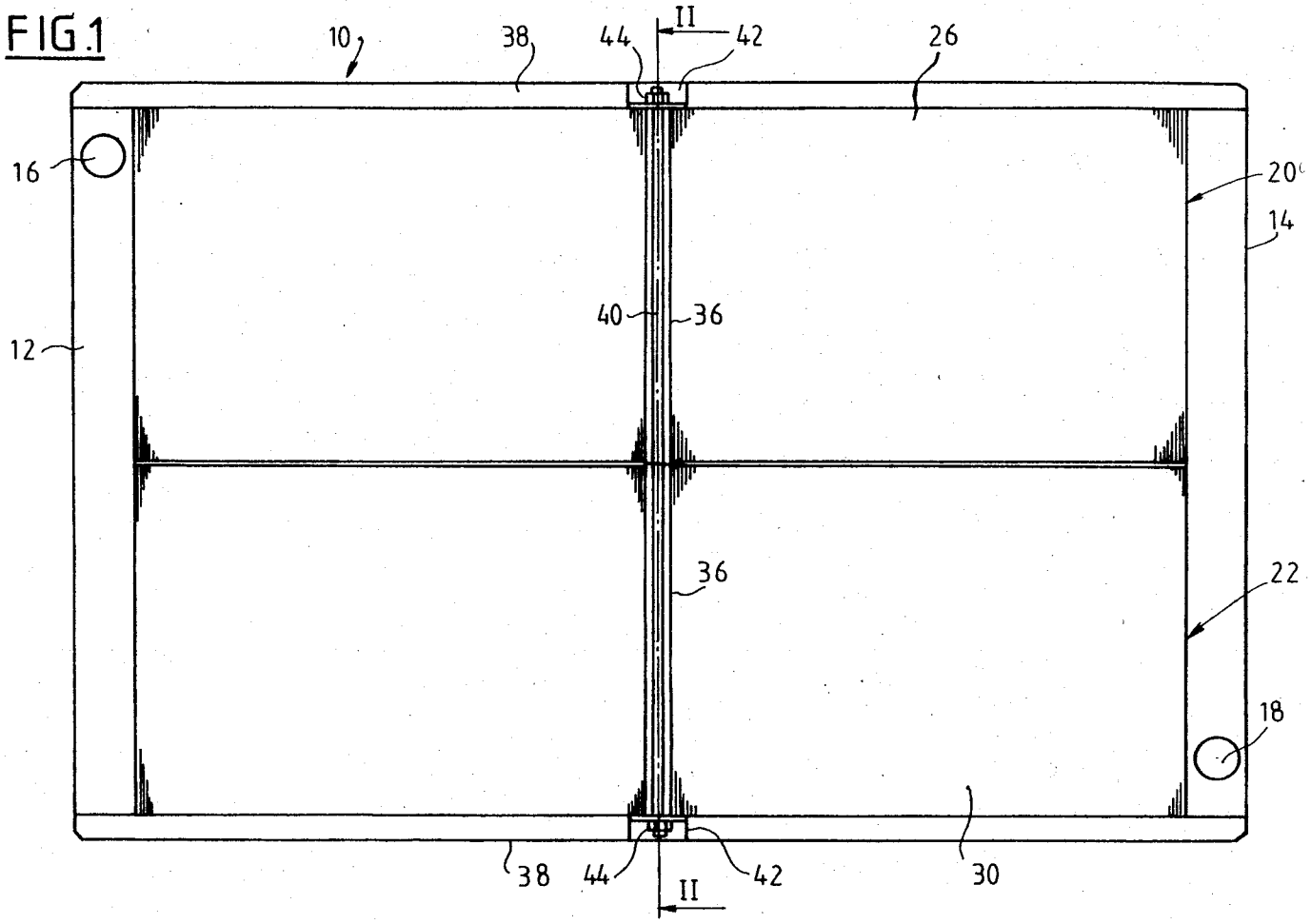
FIG. 1 is an elevation view of a heat exchanger in accordance with the invention.

The heat exchanger shown in FIG. 1 is intended, in particular, for mounting in the cooling circuit of a motor vehicle engine, e.g. in the engine of a truck.

The heat exchanger comprises a bundle 10 of finned tubes which are rectilinear and parallel, with two water boxes 12 and 14 mounted at respective ends thereof. One of the water boxes includes a liquid inlet pipe 16 and the other water box includes a liquid outlet pipe 18. These two water boxes are mounted in conventional manner at the ends of the bundle 10, e.g. by means of perforated plates through which the ends of the bundle tubes pass in sealed manner.

The heat exchanger bundle 10 is so large that it is built up from at least two sets of finned tubes 20 and 22 which are vertically juxtaposed, with the set 20 constituting the top half of the bundle, for example, and the set 22 constituting the bottom half.

In the embodiment shown (see FIGS. 2 and 3) each set 20 or 22 of finned tubes is itself made up from two subsets 24 and 26, or 28 and 30 of finned tubes which are independent from one another and which are juxtaposed in each assembly 20 or 22 in a horizontal direction perpendicular to the direction in which the two sets 20 and 22 are juxtaposed, i.e. they are juxtaposed in the direction corresponding to the thickness of the overall bundle 10.

The two subassemblies 24 and 26 of finned tubes consitituting the assembly 20 are horizontally juxtaposed in the thickness direction of the bundle as are the two subassemblies 28 and 30 constituting the set 22 of finned tubes. Further, the two subassemblies 26 and 30 of finned tubes are vertically juxtaposed as are the two subassemblies 24 and 28, i.e. in the same direction of juxtaposition as the sets 20 and 22 themselves.

Each subassembly of finned tubes is made up from rectilinear tubes disposed in parallel rows and columns and fitted with plane parallel fins 34 extending perpendicularly to the tubes 32.

Each subassembly of finned tubes includes a rigid plate 36 substantially in the middle thereof and having substantially the same plane and rectangular shape as the fins 24 in each subassembly, but being slightly larger in length and in width, said plate 36 being interposed tetween two fins 34 and being several times thicker than the fins.

The tubes 32 of a given subassembly pass through the plate 36 in the same manner as they pass through the fins 34, and at least some of the tubes are fixed to the plate in the same manner as they are fixed to the fins, e.g. by clamping by swelling or radially expanding the tube after they have been inserted through holes in the fins and the plate 36.

When all four subassemblies 24, 26, 28 and 30 of finned tubes are juxtaposed to constitute a heat exchanger bundle, the four plates 36 are likewise juxtaposed and abut against one another in pairs.

Two channel section metal cross-members 38 extend along the two small faces of the bundle 10 which are not associated with the water boxes 12 to 14. These cross-members are relatively rigid and their ends are fixed by any suitable means to the water boxes 12 and 14 or to the perforated plates associated therewith.

The cross-members 38 are also connected to each other in the middle by two parallel draw bars 40 each of which extends over one of the large faces of the bundle 10 from side to side thereof. The draw bars 40 have threaded ends which pass through holes in L-shaped tabs 42 fixed to the outside of the flanges of the cross-members 38, and tightening nuts 44 are screwed thereon.

By tightening the nuts on the threaded ends of the draw bars 40, the plates 36 between the cross-members 38 are clamped together in pairs. Since the plates 36 press against one another and against the cross-members 38 which are interconnected with a degree of prestress in their middles by the draw bars 40 and which are also rigidly fixed at their ends to the water boxes 16 and 14 (or to the perforated plates associated therewith) the bundle structure 10 thus constituted is relatively rigid and undeformable, and is insensitive, in practice, to vibrations. Further, since the length and the width of the plates 36 are slightly greater than the corresponding dimensions of the fins 34, the fins of the juxtaposed subassemblies 24, 26, 28 and 30 no longer come into contact with one another along their facing edges and are thus no longer deformed or crushed.

In the example shown, the subassemblies of finned tubes 24, 26, 28 and 30 are identical to one another. Such identity is not essential and the invention is equally applicable to building up the bundle of a heat exchanger using subassemblies of finned tubes and sets of finned tubes which are not identical to one another.

Likewise, the number of sets or the number of subassemblies of finned tubes constituting the bundle 10 is not limited to the examples described.

What is claimed is:

1. A heat exchanger, in particular a radiator for the cooling circuit for the engine of a motor vehicle, the heat exchanger comprising a bundle of finned tubes including multiple parallel tubes and fins extending perpendicular to the tubes and defining major and minor faces, and at least one water box mounted at one end of the bundle, said bundle being built up from at least two independent juxtaposed sets of finned tubes, the heat exchanger improvement including a pair of spaced parallel cross-members extending along selected minor faces of the bundles parallel to the tubes and interconnected to each other in the middle by two draw bars, said draw bars urging the sets of finned tubes towards one another in a plane perpendicular to the tubes of said sets, each set of finned tubes is provided with plate means for bearing against corresponding plate means in the other sets of tubes in a plane perpendicular to the tubes upon an urging of the sets of finned tubes toward one another by said draw bars and said cross-members being interconnected at their ends by said plate and water box assemblies of the heat exchanger.

2. A heat exchanger according to claim 1, wherein said plate means of each set of finned tubes comprises a rigid plate having substantially the same shape as a fin and having slightly greater dimensions, said rigid plate being interposed between two fins in the corresponding set and the tubes of said corresponding set passing through said plate.

3. A heat exchanger according to claim 2, wherein each of said rigid plates is located in the middle of the corresponding set of finned tubes.

4. A heat exchanger according to claim 2, wherein said first means comprises two parallel cross-members extending along two small faces of the bundle parallel to the tubes and interconnected to each other in the middle by two draw bars, said rigid plates of said sets of finned tubes being juxtaposed in a common plane perpendicular to the tubes and are clamped against one another and between said cross-members by said two draw bars.

5. A heat exchanger according to claim 2, wherein each rigid plate is fixed to at least some of the tubes passing therethrough.

6. A heat exchanger according to claim 2, wherein said rigid plates are several times thicker than the fins.

7. A heat exchanger according to claim 6, wherein said rigid plates are made of plastic material and are about 10 mm thick.

8. A heat exchanger according to claim 2, wherein said rigid plates include lightening cavities.

9. A heat exchanger according to claim 2, wherein each set of finned tubes is itself built up from two independent subassemblies of finned tubes which are juxtaposed in a direction perpendicular to the direction in which said two sets of finned tubes are juxtaposed, each subassembly of finned tubes including a rigid plate having substantially the same shape as a fin of the subassembly and having slightly greater dimensions, said rigid plate being interposed between two fins of the subassembly with the tubes of the subassembly passing through the rigid plate, each of said rigid plates, in the finished heat exchanger, bearing against: a cross-member extending parallel to the tubes along one of two opposed small faces of the bundle; a corresponding plate in the other subassembly of the same set of finned tubes; and a corresponding plate of a corresponding subassembly in the other set of finned tubes.

10. A heat exchanger according to claim 1, wherein the cross-members have opposed ends at the opposed ends of the bundle, said cross-members being connected to each other at their ends.

11. A heat exchanger according to claim 1, wherein said plate means of each set of tubes comprises a rigid plate having substantially the same shape as a fin and having slightly greater dimensions, said rigid plate being interposed between two fins in the corresponding set and the tubes of said corresponding set passing through said plate, each rigid plate paralleling the fins of the corresponding set and, upon bearing against the rigid plate of another set, spacing the fins of the sets from each other.

12. A heat exchanger according to claim 11, wherein each of said rigid plates is located in the middle of the corresponding set of tubes.

13. A heat exchanger according to claim 11, wherein said rigid plates of said sets of tubes are juxtaposed in a common plane perpendicular to the tubes and are clamped against one another and between the cross-members extending in parallel along the opposed sides of the bundle by said two draw bars.

14. A heat exchanger according to claim 11, wherein said rigid plates are several times thicker than the fins.

15. A heat exchanger according to claim 11, wherein each set of finned tubes is itself built up from two independent subassemblies of finned tubes including parallel tubes and fins perpendicular thereto, said subassemblies being juxtaposed in a direction perpendicular to the direction in which said two sets of finned tubes are juxtaposed, each subassembly of tubes including a rigid plate having substantially the same shape as a fin of the subassembly and having slightly greater dimensions, said subassembly rigid plate being interposed between two fins of the subassembly with the tubes of the subassembly passing through the rigid plate, each of said rigid plates, in the finished heat exchanger, bearing against a cross-member along one of the two opposed sides of the bundle, a corresponding plate in the other subassembly of the same set of finned tubes, and a corresponding plate of a corresponding subassembly in the other set of finned tubes.

* * * * *